United States Patent [19]

Hennessy

[11] Patent Number: 4,779,909

[45] Date of Patent: Oct. 25, 1988

[54] THUMB LATCH ACTUATOR MECHANISM

[75] Inventor: Thomas F. Hennessy, Bristol, Conn.

[73] Assignee: Lori Corporation, Southington, Conn.

[21] Appl. No.: 3,472

[22] Filed: Jan. 15, 1987

[51] Int. Cl.[4] ..... E05C 21/00

[52] U.S. Cl. ..... 292/166; 292/336.3

[58] Field of Search ..... 292/166, 167, 173, 169.19, 292/169.23, 336.3

[56] References Cited

U.S. PATENT DOCUMENTS

| | | | |
|---|---|---|---|
| 2,177,948 | 10/1939 | Schindler | 292/169.19 |
| 2,397,671 | 4/1946 | Larson | 292/167 X |
| 2,648,969 | 8/1953 | Miller et al. | 292/167 X |
| 2,665,154 | 1/1954 | Hagstrom | 292/169.19 X |
| 3,020,073 | 2/1962 | Williams | 292/169.19 X |

*Primary Examiner*—Richard E. Moore

*Attorney, Agent, or Firm*—Chilton, Alix & Van Kirk

[57] ABSTRACT

A latch actuator mechanism (10) having a housing (18) in which is mounted a lever (40) that engages a carrier member (54) that surrounds a spindle (66). The spindle includes a radial projection (74) that engages a recess (60) in the carrier member (54) such that as the lever (40) is pivoted, it linearly displaces the carrier member which in turn bears upon the projection (74) to rotate the spindle (66). The spindle is connected to a latch (16) that extends transversely to the axis of the spindle and is actuated for engagement and disengagement to strike (82). The preferred latch mechanism includes an elongated latch case (88) mounted transversely on the spindle (66), the latch having a retractor member (96) mounted for linear displacement longitudinally within the case and a latch bolt head (114) adapted for a projected and a withdrawn position relative to the case. An annular, semi-circular hub (92) is affixed to the spindle within the case for converting the rotational motion of the spindle into a linear displacement of the retractor member, whereby the bolt head may be drawn to its retracted position. A spring member (112) interposed between the forward portion of the retractor member and the hub provides a forward bias on the retractor member such that upon release of the latch actuating force on the spindle, the retractor and bolt head will automatically return to the forward, or engaged position.

17 Claims, 5 Drawing Sheets

THUMB LATCH ACTUATOR MECHANISM

BACKGROUND OF THE INVENTION

This invention relates to latch mechanisms, and more particularly to thumb latch hardware for doors.

In many applications, a handle and latch actuation mechanism are disposed near each other so that the user may grasp the handle and, with the downward movement of the thumb, simultaneously actuate the latch mechanism to disengage a bolt from the door frame or cooperating door of a set of doors. Such thumb actuated latch mechanisms should be simple and easy to use, and the construction thereof should be sturdy enough to hold up under many years of constant use, yet be inexpensive to fabricate and assemble.

SUMMARY OF THE INVENTION

The present invention includes an actuator mechanism wherein pivotal motion in one plane, typically a vertical plane, can be easily and reliably translated into rotational motion about an axis which lies in another plane. More particularly, the invention in a preferred form is a door latch actuation mechanism by means of which the user, through depression of a pivotal thumb piece, will produce a rotational motion about an axis which is perpendicular to a vertical plane defined by the face of the door, such rotational motion causing actuation of a latch member.

The actuator mechanism of the present invention is in the form of a housing with associated structure for interacting with a latch mechanism which has an actuable portion located in an aperture running from the front to the back of the door near the door handle. In accordance with the invention, a thumb piece lever is pivotally mounted to the housing and has a nose portion which engages a carrier member adapted to move linearly within the housing. A spindle extends through the housing and includes collar means for engaging the movable carrier member. The thumb piece, carrier member, and spindle are coupled such that, when the user depresses the thumb piece, the carrier member moves linearly and thereby rotates the collar which, in turn, imparts rotational motion to the spindle. The spindle, in turn, is connected by a hub to the latch mechanism. The thumb piece is preferably situated adjacent the handle so that the user may easily disengage the latch while grasping the handle, and in a continuous hand motion, open the door.

Although the present latch actuation mechanism may be used in conjunction with a rotatable bar or hook-type latch, in the preferred utilization the latch actuation mechanism is coupled to a latch which has a linearly moveably latch bolt. A preferred linear latch mechanism includes a retractor body mounted within a latch case for movement in a channel oriented transversely with respect to the spindle. A second hub member is connected to the spindle such that rotation of the spindle by the latch actuation mechanism produces a linear motion of the retractor in the channel. A latch bolt head extends from the retractor and is coupled thereto by a latch tail. A latch spring is located between the latch bolt head and the retractor, and a retraction spring is located between the retractor and the second hub. This dual spring arrangement maintains an outward bias on the latch bolt head, permits retraction of the latch bolt head as the hub is rotated to displace the retractor linearly within the channel and permits displacement of the latch bolt head without rotation of the hub when the bolt head is cammed inwardly by contact with the lip portion of a strike. Upon release of the latch actuation force, the retraction spring returns the retractor and the latch bolt head to the forward position whereby the latch bolt head is engaged with a bolt receiver provided in the door frame and typically defined in part by a rectangular aperture in the strike plate.

BRIEF DESCRIPTION OF THE DRAWING

The preferred embodiment of the invention is described below with reference to the accompanying drawings wherein like reference numerals refer to like elements in the several figures and in which.

DESCRIPTION OF THE PREFERRED EMBODIMENT

Figure 1:
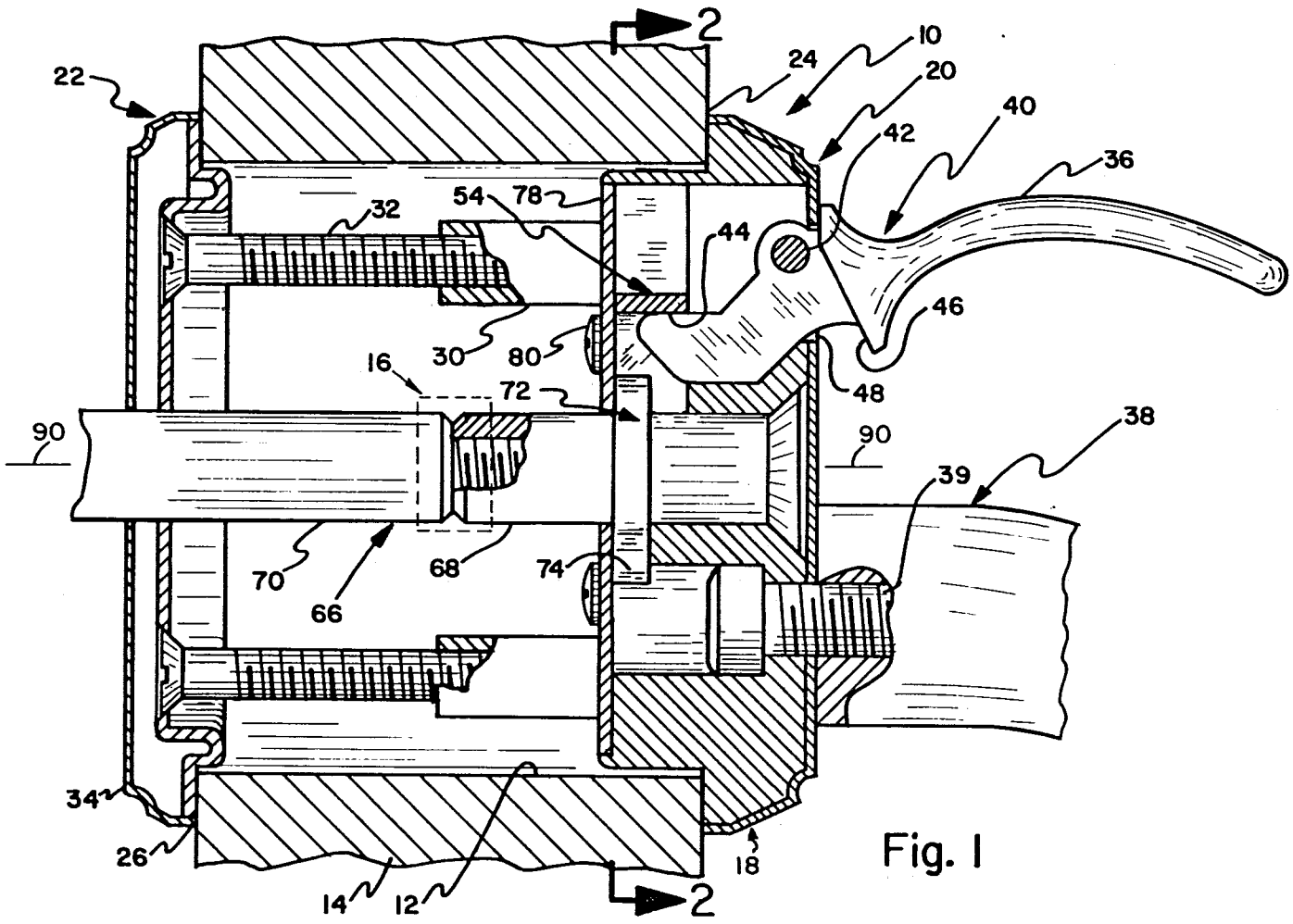
FIG. 1 is a partially sectioned, elevation view of a latch actuation mechanism in accordance with the invention.
Figure 3:
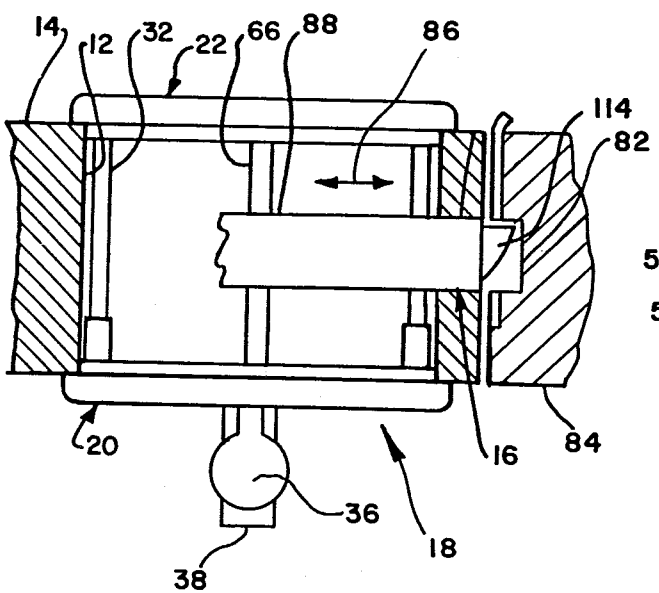
FIG. 3 is a schematic illustration of the latch actuation mechanism of the present invention, coupled to a latch mechanism for engaging a receptable in the door frame.

FIGS. 1 and 3 show a latch actuation mechanism, indicated generally at 10, associated with an aperture 12 provided in a door 14, the aperture having an axis which is generally perpendicular to parallel planes defined by the faces of the door. The door has mounted therein a latch mechanism indicated generally at 16, the outline of which is shown in phantom in FIG. 1. Latch mechanism 16 is positioned within a further aperture which intersects aperture 12 and is partly situated in the aperture 12 and has an axis which extends parallel to the aforesaid planes of the door. The latch mechanism 16 is operatively associated with to a strike mounted on the door frame for engagement or disengagement when the door is to be closed or opened.

The latch actuation mechanism includes a housing, indicated generally at 18, defined by front and rear halves indicated respectively and generally at 20, 22. Preferably, the halves of the housing include cover members with front and rear flanged portions 24, 26 for mating with the exterior surfaces of door 14 as shown. Bosses 30 are connected directly or indirectly to the housing front half 20, and housing bolts 32 pass through the rear half 22 for engagement with the threaded bosses 30, so that the housing can be rigidly assembled and mounted within the aperture 12. A rear cover plate 34 is provided as part of housing half 22 to prevent access to the bolts 32 at the inside of the door. If the door handle 38 is to be mounted in whole or in part on the front housing half 20, it can be secured thereto, from within the front half, by means of bolt 39.

A thumb piece lever, indicated generally at 40, is pivotally connected at 42 to the front housing 20 and includes a nose portion 44 and an arm portion 36 that can be vertically depressed by the user to operate the latch mechanism 16. The lever 40 passes through a slot 42 in the front housing 20, and preferably includes stop shoulders 46 adjacent the outer surface of front housing 20. Preferably, the thumb piece arm 36 is disposed adjacent the handle 38 so that the user may conveniently press the arm while grasping the handle.

Figure 2:
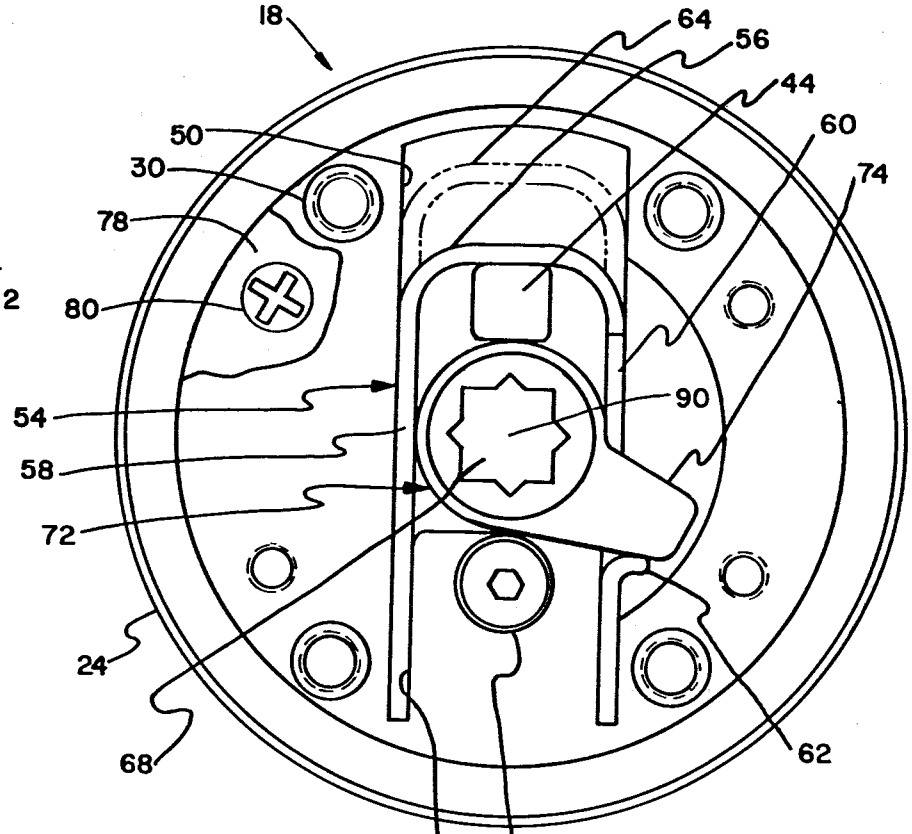
FIG. 2 is a transverse view, partly in section, taken along line 2—2 of FIG. 1.

The manner in which rotation of the arm 36, in a first plane perpendicular to the face of the door 14, is translated into a rotational motion, in a second plane perpendicularly to the first plane and oriented generally parallel to the planes of the door faces, will be described in connection with FIGS. 1 and 2. FIG. 2 is a transverse view of the actuator mechanism 10, taken along line 2—2 of FIG. 1. The front housing 20 is preferably cast from zinc or similar material, and has formed therein guide means 50. Guide means 50 includes parallel, vertically oriented track portions 52. A movable carrier member, indicated generally at 54 and preferably in the form of an inverted "U", is located in guide means 50 for vertical movement along the track 52. The carrier member 54, in the form shown, includes a base portion 56 and legs or side walls 58, at least one of which is provided with a slot or recess 60. Preferably, an outward lip 62 is formed at the lower edge of the slot 60 to provide a land surface for reasons to be explained below. The nose portion 44 of the lever 40 engages the base portion 56 of the movable member, such that when the arm 36 is fully depressed, the carrier member 54 is raised from the position shown in FIGS. 1 and 2 to an upper limit position 64 as indicated by broken lines in FIG. 2.

A rotatable rod or spindle 66 is supported between the front and rear housing halves 20, 22, and is interconnected with the latch mechanism 16 such that rotation of the spindle 66 about its access 90 (FIG. 2) actuates the latch mechanism 16. The spindle 66 preferably comprises a female rod portion 68 that enters the housing through front half 20 and a male portion 70 that enters the housing through rear half 22, the rod portions being telescopically joined in the interior of the actuator mechanism 10.

A collar 72 or similar means is mounted on to the female rod portion 68 for rotation therewith as shown, the collar including a lobe portion 74 which extends radially outwardly. The collar 72 is mounted on the rod member 68 at a position where the rod member passes through the movable carrier member 54 such that the lobe 74 engages the slot or recess 60. The lobe 74 rests upon the lip 62 at the end of slot 60. Accordingly, as the nose 44 of lever 40 raises the carrier member 54, the lobe rotates the spindle 66. Preferably, the collar 72 engages the rod 68 through a spline connection to help assure long life.

In the illustrated embodiment, a retainer plate 78 is secured to the front housing 20 by means of screws 80. The retainer plate assures that the carrier member 54 remains in the track 52 and that the lobe 74 remains in the recess 60. The bosses 30 are preferably formed on the retainer plate 78.

FIG. 3 illustrates schematically the relationship between the actuating mechanism 10 of the present invention and the preferred latch mechanism 16 for selectively engaging and disengaging a strike 82 in the door frame 84. The latch mechanism is mounted with its axis extending transversely with respect to the axis of the spindle 66, substantially in a plane which is parallel to the faces of the door. In accordance with the preferred latch mechanism, which is described in greater detail below, the rotational motion of the spindle 66 is converted into linear motion indicated by the arrow 86. It should be appreciated that other types of latches may be used with the latch actuation mechanism of the present invention, such as hooks or other latches that rotate about the spindle substantially in the plane of the door.

Figure 4:
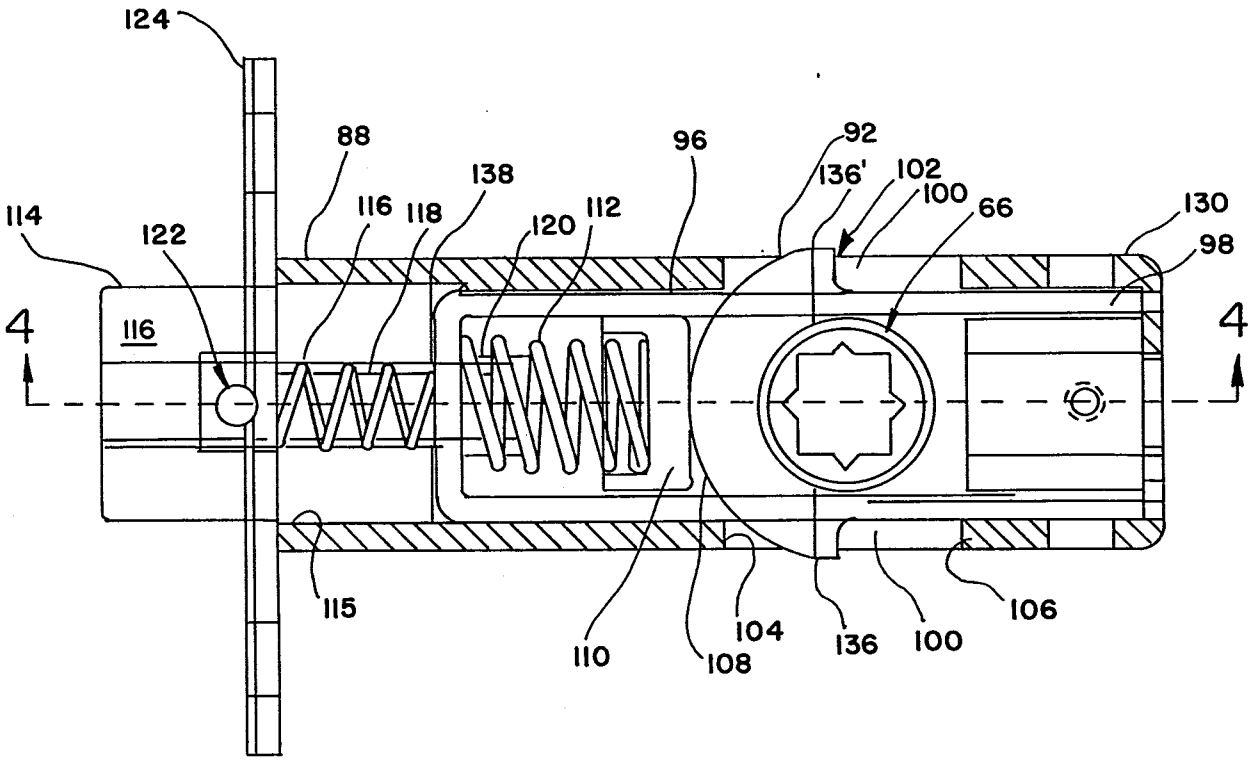
FIG. 4 is a side view, in section, of a preferred latch mechanism in which the rotational motion of the latch actuation mechanism is converted into a linear movement of a latch bolt.
Figure 5:
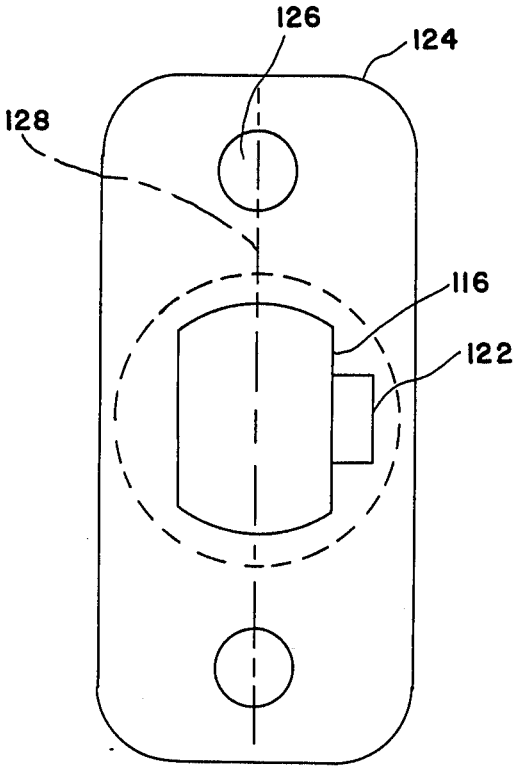
FIG. 5 is an end view of the latch mechanism of FIG. 4 taken from the left.
Figure 6:
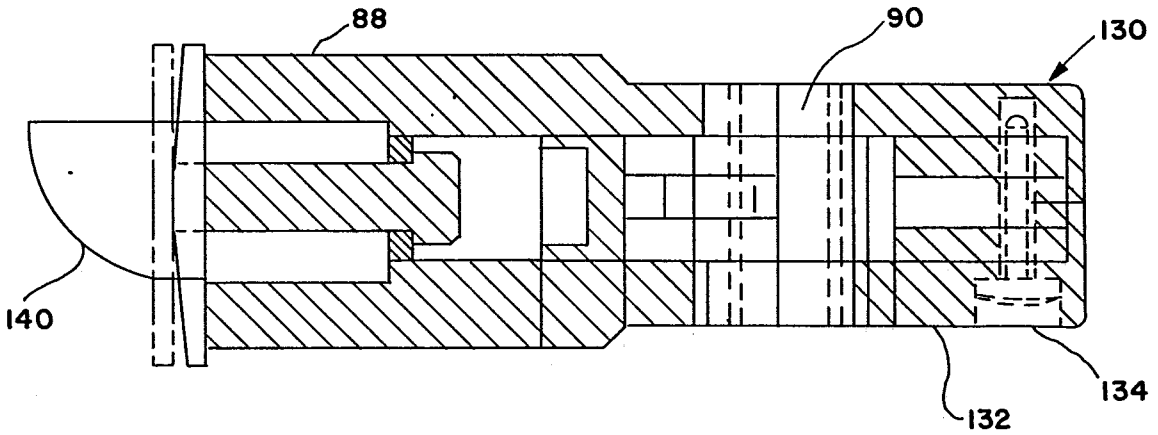
FIG. 6 is a plan view, in section, of the latch mechanism of FIG. 4.

With reference now to FIGS. 4–6, the aspect of the present invention directed to the preferred latch mechanism will be described. As a point of reference, the spindle 66 and the tubular latch case 88 are mounted perpendicularly with respect to one another. As shown in FIG. 6, a bore 90 in the latch case is adapted to receive the spindle. A half hub member 92 (FIG. 4) is coupled to the spindle 66 for rotation therewith. The latch case houses a retractor member 96 which is adapted to move linearly in guide channels 98 which are oriented parallely with respect to the longitudinal axis of the latch case. The latch case 88 is provided with oppositely disposed windows 100 adjacent the spindle, and lips 102 are formed on the retractor 96 for cooperation with hub 92.

The half hub 92 is adapted to maintain contact with a lip 102 such that, upon rotation of the spindle 66, the hub 92 rotates and forces the lip 102, and thus the entire retractor 96, to move linearly within the latch case 88, the window 100 providing clearance for movement of the lip. The half hub 92 is preferably in the form of an annular segment spanning 180 degrees. A retractor spring 112 is interposed between the forward portion of the retractor member 96 and a base 110 which is cast into case 88 for maintaining a forward bias on the retractor 96 relative to the spindle 66 and half hub 92. In the present description, "forward" should be understood to mean the direction whereby the latch bolt head 114 moves into engagement with a recess which is in registration with a hole in a strike 82 mounted in the door frame, and the term "rearward" should be understood to mean the direction whereby the latch bolt head 114 is retracted from such engagement. The latch bolt head 114 is biased forwardly relative to the retractor body 96, by a latch spring 116 located therebetween. Preferably, the latch spring is coiled about a rod-like latch tail 118 which is connected, i.e., joined by a cross pin 122, at its forward end to the latch bolt head 114. The head 114, which extends approximately to the forward end of case 88 with the latch in the condition depicted in FIG. 4, passes through an opening 115 in the forward end of the latch case 88. The rearward end of the latch tail 118 penetrates the front end of the retractor 96 and preferably includes an enlarged portion 120 for enabling the retractor, when drawn rearwardly, to pull the latch tail. The retraction of the latch bolt is caused by the pin connection 122 of its forward end to the latch bolt head 114.

Preferably, the latch tail 118 does not penetrate through the latch bolt head 114, but rather is mounted on a side surface 116 thereof, as is evident from the end view of FIG. 5. FIG. 5 shows a mounting plate 124 and mounting holes 126 for supporting the latch at the exterior edge of the door. Although the latch bolt head is centered within the mounting bracket, the latch tail and pin, by which the forward end is connected to the latch bolt head, are offset relative to the vertical plane 128 which bisects the mounting plate.

As may best be seen from FIG. 6, the latch case 88 is typically formed in two halves 130, 132 which facilitates the placement of the internal components and attachment to the spindle prior to connection of the two halves by case screw 134 or the like.

The arrangement of components described immediately above has a neutral or default condition wherein the latch bolt head 114 projects from the mounting plate 124 due to the spring biased forward position of the retractor 96 relative to the half hub 92 and the spring biased forward position of the latch bolt 114 relative to the retractor 96. In this neutral condition, wherein no latch actuating force is maintained on the spindle 66, the retraction spring 112 urges the retractor 96 and the lip portion 102 thereof to a forward limit position characterized by the contact of each of the pair of lips 102 against the respective flat portions 136, 136' at the ends of the annulus defining the half hub 92.

When the spindle 66 is rotated for actuating and thus retracting the latch bolt head 114, the half hub 92 is rotated either clockwise or counterclockwise. Taking clockwise in FIG. 4 as an example, the end surface 136' moves rearwardly, pushing and maintaining contact on the lip 102, thereby pushing the entire retractor member 96 rearwardly. The opposite end 136 of the half hub separates from the other lip. The rearward movement of the retractor 96 pulls the latch tail 118 and with it the latch bolt head 114, thereby disengaging and retracting the head from the bolt receiving recess in the door frame. The head 114 remains in the withdrawn position so long as the rotational force is maintained on the spindle 66.

Upon release of the force on the latch actuator, and thus the spindle 66, the retractor spring 112 decompresses and thereby biases the retractor 96 in the forward direction until the two lips 102 return to the neutral position in contact with the ends 136, 136' of the half hub. This has the effect of automatically rotating the spindle 66 and returning the latch actuation lever 36 (FIG. 1) to its default position. Also, the front portion 138 of the retractor 96 urges the bolt head 114 outwardly into the engaged position.

With reference also to FIG. 3, it can also be appreciated that when the door having the described latch mechanism is opened and the lever 36 released; the latch bolt head 114 will project from the plate 124. As the door 14 is swung towards a closed position, the curved surface 140 of the bolt head impacts on a cooperating curved lip extension of the strike 82. This impact imparts a force having a component that drives the head rearwardly within the latch case 88. This rearward movement of the bolt head pushes the latch tail 118 rearwardly in the channels 98 but without imposing any forces on the half hub 92. As the door reaches its fully closed position in the door frame, the bolt head is urged outwardly into the recess behind the strike by the latch spring 116.

It may thus be appreciated that the disclosed latch mechanism is well suited for use with an actuation mechanism that produces a rotation in the spindle, whether of the preferred type described in connection with FIGS. 1 and 2, or of other conventional actuators such as a door knob. With the preferred latch mechanism, the rotational motion of thumb piece member 36 about pivot 42 is in a vertical plane perpendicular to the plane of the door, and the rotation of half hub 92 is in a vertical plane parallel to the plane of the door. It should be understood that the present invention can be used to actuate latch members other than the type described with respect to FIG. 3, so long as a similar rotational motion induced translation is required.

While a preferred embodiment has been shown and described, various modifications and substitutions can be made thereto without departing from the spirit and scope of the invention. Accordingly, it is to be understood that the invention has been described by way of illustration and not limitation.

What is claimed is:

1. An actuator for a latch mechanism comprising:

housing means, said housing means having front and rear portions;

a lever mounted on said housing means front portion, said lever being pivotal in a first plane about an axis and including an arm portion extending outwardly from said housing means front portion, said arm portion being movable between first and second positions in said first plane during said pivotal motion, said lever further including a nose portion facing said housing means rear portion, said arm and nose portions being on opposite sides of said axis;

means for engaging and actuating a latch mechanism, said engaging and actuating means including a rotatable member mounted between said housing means front and rear portions;

carrier means mounted in said housing means front portion for linear displacement, said carrier means comprising a generally U-shaped member having a base and two legs, one of said legs including an aperture, said rotatable member passing between said legs of said U-shaped member, said base of said U-shaped member being oriented generally transversely with respect to said first plane, said lever nose poriton being located in part within said carrier means U-shaped member between said base and said rotatable member; and coupling means extending radially from said rotatable member into said aperture, pivotal motion of said lever nose portion in a first direction imparting linear motion to said carrier means in the first direction by contact with said base of said U-shaped member, linear motion of said carrier means being translated into rotation of said rotatable member by said coupling means as a result of motion imparted to said coupling means by the engagement thereof with the said one leg of said U-shaped member at said aperture.

2. The actuator of claim 1 wherein said one leg of said U-shaped member includes an outwardly flared lip at one end of the aperture for engaging said coupling means.

3. The actuator of claim 1 wherein said coupling means includes a collar affixed to said rotatable member where said rotatable member passes between said legs of said U-shaped member.

4. The actuator of claim 1 wherein said rotatable member comprises a first rod passing through the front portion of said housing means and said carrier means, said rotatable member further comprising a second rod passing through the rear portion of said housing means, said first and second rods being joined together within said housing means.

5. A mechanism for translating rotational movement to reciprocal motion to actuate a latch, comprising:

a front housing member and a rear housing member;

a lever pivotally mounted on said front housing member, said lever including an arm portion extending outwardly from said front housing and a nose portion extending toward said rear housing;

guide means associated with said front housing for defining a linear track;

carrier means disposed in said guide means defined track and engaging said nose portion, for movement along said track in response to pivotal motion of said lever;

a spindle member extending between said front and rear housing members and through said carrier means transversely with respect to said track, said spindle member including lobe means extending radially therefrom into engagement with said carrier means, said spindle member further including means adapted to engage the latch; and means for rigidly interconnecting said front and rear housing halves;

whereby movement of said carier means in said track produces rotation of said spindle member about an axis joining the front and rear housing members.

6. The mechanism of claim 5 wherein said lever is pivotally mounted on an upper portion of the front housing member, and a handle is mounted on a lower portion of the front housing member.

7. The mechanism of claim 5 wherein the carrier means is in the form of an inverted "U" shaped member and the legs of the carrier member are located in the tracks.

8. The mechanism of claim 7 wherein one leg of the carrier member has a recess therein for engagement with the lobe means.

9. The mechanism of claim 7 wherein the lobe means includes a collar rigidly formed on the rod member, the collar including a radial projection for engaging the frame means.

10. An actuator for a latch mechanism comprising:

housing means, said housing means having front and rear portions;

a lever mounted on said housing means front portion, said lever being pivotal in a first plane about an axis and including an arm portion extending outwardly from said housing means front portion, said arm portion being movable between first and second positions in said first plane during said pivotal motion, said lever further including a nose portion which faces said housing means rear portion, said arm and nose portiosn being on opposite sides of said axis;

carrier means mounted in said housing means front portion for linear displacement, said carrier means including at least one side wall and a base oriented generally transversely with respect to said one side wall, said base being engaged by said lever nose portion and being oriented generally perpendicularly with respect to said first plane whereby pivotal motion of said lever nose portion in a first directon will impart linear motion to said carrier means in said first direction;

means for engaging and actuating a latch mechanism, said engaging and actuating means including a rotatable member mounted between said housing means front and rear portions; and coupling means extending from said rotatable member and engaging said carrier means one side wall, whereby linear motion of said carrier means in said first direction will displace said coupling means and thereby impart rotation to said rotatable member to produce a force for causing operation of a latch mechanism.

11. The actuator of claim 10 wherein said side wall of said carrier means includes an aperture for receiving and engaging said coupling means.

12. The actuator of claim 11 wherein said coupling means includes a collar affixed to said rotatable member and an arm extending radially from said collar to said carrier means side wall, said arm being received in said aperture.

13. The actuator of claim 12 wherein said rotatable member comprises a first rod extending from the front portion of said housing means and a second rod extending from the rear portion of said housing means, said first and second rods being joined together within said housing.

14. A mechanism for actuating a latch comprising:

means defining an actuator housing;

a lever pivotally mounted on said housing defining means, said lever including an arm portion extending out of the housing and a nose portion extending into the housing;

a carrier member mounted within the housing and coupled to said lever nose portion for linear displacement in response to pivotal movement of said lever, said carrier member being generally U-shaped;

means supported within the housing for engaging and actuating a latch, said latch engaging and actuating means including a rotatable spindle which is juxtapositioned to said carrier member; and means coupling said spindle to said carrier member whereby linear displacement of said carrier member by said lever nose portion imparts rotational motion to said spindle.

15. The mechanism of claim 14 wherein said U-shaped carrier member is inverted and has a base portion with a pair of legs extending therefrom, said lever nose portion engages the base of said carrier member, and wherein one leg of said carrier member has an aperture for engaging said means for coupling said spindle to said carrier member.

16. The mechanism of claim 14 further including a latch mechanism comprising:

an elongated latch case having a forward end and a rearward end, the forward end having an opening therein;

a hub extending from the spindle for rotation therewith inside the latch case;

a retractor member mounted in the case for linear longitudinal movement therein, said retractor member including means engaging said hub, such that when said hub is rotated by said spindle, said retractor member is displaced rearwardly within the latch case;

a latch bolt head supported at the forward end of the case for movement through said opening between a position projecting out of said opening and a retracted position entirely within the case;

first means, for biasing the retractor member in a forward direction such that said means engaging said hub is maintained in contact with said hub;

second means, for biasing the bolt head in a forward direction; and means connecting said retractor member to said bolt head for drawing said head rearwardly in unison with said retractor member when said retractor member is moved rearwardly by rotation of said hub, and for pushing said head forwardly in unison with said retractor member to project outwardly from said opening when the rotational force on said hub is released.

17. The mechanism of claim 16 wherein said hub includes an arcuate outer surface portion and a pair of substantially flat end surfaces at opposite ends of said arcuate portion, and wherein said first spring means includes a coil spring fixed at its forward end to the forward portion of the retractor member.

* * * * *